US007625289B1

(12) United States Patent
Fagliarone

(10) Patent No.: US 7,625,289 B1
(45) Date of Patent: Dec. 1, 2009

(54) MARTIAL ARTS DEMONSTRATION STAFF

(76) Inventor: John Fagliarone, 14 Tara Dr., East Stroudsburg, PA (US) 18301

( * ) Notice: Subject to any disclaimer, the term of this patent is extended or adjusted under 35 U.S.C. 154(b) by 0 days.

(21) Appl. No.: 11/443,854

(22) Filed: May 31, 2006

(51) Int. Cl.
*A63D 15/08* (2006.01)

(52) U.S. Cl. ..... 463/47.2; 463/47.5; 362/102; 362/577; 446/473

(58) Field of Classification Search ..... 463/47.2, 463/47.4; 135/910; 362/551, 555, 565, 577, 362/217, 219, 222, 223, 224, 225, 102; 446/219, 446/397, 401, 405, 216
See application file for complete search history.

(56) References Cited

U.S. PATENT DOCUMENTS 4,054,302 A * 10/1977 Campbell ..... 280/477
4,203,252 A * 5/1980 Howie ..... 446/216
4,678,450 A * 7/1987 Scolari et al. ..... 446/405
5,279,513 A * 1/1994 Connelly ..... 446/219
5,306,193 A * 4/1994 Yang ..... 446/215
5,392,203 A * 2/1995 Harris, Jr. ..... 362/186
5,725,440 A * 3/1998 Finney ..... 473/220
5,746,640 A * 5/1998 Meadows ..... 446/213
5,873,571 A * 2/1999 Vaisman et al. ..... 273/292
5,967,638 A * 10/1999 Gorman et al. ..... 362/84
5,980,063 A * 11/1999 Ford et al. ..... 362/186
6,110,102 A * 8/2000 Harrison ..... 600/38
6,126,292 A * 10/2000 Liu ..... 362/102
6,165,078 A * 12/2000 Holt ..... 473/44
6,244,723 B1 * 6/2001 Talamo ..... 362/208
6,299,537 B1 * 10/2001 Clowser ..... 463/47.5
6,337,946 B1 * 1/2002 McGaffigan ..... 385/146
6,672,552 B1 * 1/2004 Jao ..... 248/251
6,857,771 B2 * 2/2005 Guerrieri ..... 362/555
7,111,425 B1 * 9/2006 Cormier ..... 43/17.5
7,229,200 B1 * 6/2007 Bender et al. ..... 362/573
7,288,037 B2 * 10/2007 Myers ..... 473/613

OTHER PUBLICATIONS http://www.instructables.com/id/ECT7K631PGEXCFFCLE/?ALLSTEPS, website describing Lit Bo Staff for night practice made from acrylic, 1, 2007.*
http://www.neonhusky.com/JShop/product.php/88/0/, website for clear staff, Apr. 2005.*
http://www.karatedepot.com/wp-bo-012.htm, website for Multilens Demonstration Bo Staff, Jul. 2004.*

* cited by examiner

*Primary Examiner*—William M Pierce
(74) *Attorney, Agent, or Firm*—Charles A. Wilkinson; Clinton H. Wilkinson

(57) ABSTRACT

A martial arts demonstration bong is formed of highly polished transparent plastic and provided with end mounted illumination means directed inwardly in line with the bong shaft. The bong is provided with rank indicating colored ring indicators at the ends of a handgrip section in an unstressed section and may be provided with a surface air current whistling device.

12 Claims, 2 Drawing Sheets

MARTIAL ARTS DEMONSTRATION STAFF

BACKGROUND OF THE INVENTION

1. Field of the Invention

The present invention relates to martial arts training weapons and implements generally, and more particularly to weapons and implements for use during martial arts demonstrations, and more particularly still to a more aesthetically appealing acrylic martial arts demonstration staff or bong including features such as an illumination means, a sound emitting means, and strategically positioned custom engravings and markings which do not reduce the structural integrity of the staff.

2. Preliminary Discussion

Traditional martial arts are practiced today not only for self-defense, fighting and/or combat training, as well as for teaching mental discipline and self-confidence, but also in general as a sport or recreational activity and to promote physical fitness. There are, of course, numerous different martial arts disciplines, each of which has a slightly difference focus or concentration. For example, judo concentrates on throwing techniques, while taekwondo concentrates on kicking techniques, and karate concentrates more on defensive and striking techniques, although each discipline utilizes all of such techniques as well as weaponry to at least some extent.

A weapon commonly used for both offensive and defensive purposes is the bo staff. According to "The Dictionary of Martial Arts" by Emil Farkas & John Corcoran, BoJutSu (boh-jut'su) Jap. "art of the staff", is an armed system of combat based on the use of a long wooden staff called a bo. It is thought by many that the bo staff originated from the tenbin, a pole that is laid across and balanced on the shoulders and used to carry supplies such as buckets containing water or grain hanging from the ends of the pole, and it is further believed that such poles were first used as weapons in China. The staff is usually made of a hard wood, often red or white oak, or ash, that will not break easily when used in combat, and typically has a length of between five to six feet, or preferably a few inches taller than its user, and a diameter of approximately one inch. Such weapon is well balanced, as the center of the staff serves as the weapon's fulcrum, and is typically employed with a two-handed gripping action. Use of the staff was learned in most schools of martial arts in feudal Japan and it is still used in many types or styles of martial arts today, with techniques practiced including striking, thrusting, blocking, parrying, deflecting, sweeping, and holding. By quickly changing one's grip, the length of the staff can be easily varied for use in either long-range or close-quarter combat, and when used properly can in effect serve as an extension of one's own limbs.

As indicated above, by necessity the staff is made of a very sturdy material such as a hard wood that will not break when used to strike or block a blow. However, in teaching and practice, as well as in martial arts demonstrations, which demonstrations are essentially events wherein the skills one has developed while studying a martial arts discipline are displayed to an audience in a skillful and entertaining manner, martial arts weapons are usually made of lighter materials or have padded striking surfaces to prevent or reduce the likelihood of an injury occurring. A typical prior art demonstration bo staff, for example, is made of a hollow metal such as aluminum or an ultra light wood having a chrome finish, which finish is flashier and therefore more noticeable and aesthetically attractive or eye catching than a typical wood finished staff when twirled or moved quickly through the air, particularly where bright spotlights or the like are also directed at the user. The lighter weight also makes the staff easier to handle and maneuver, particularly when used by children and young adults. There remains a need, however, for martial arts demonstration weapons that not only better highlight the user's skills but also increase the enjoyment of the spectators and provide an overall more aesthetically pleasing demonstration or performance. The present inventor, recognizing such need, has thus developed an improved acrylic demonstration staff that, it is believed, is significantly more aesthetically pleasing, and in addition serves as a personalized memento and indicator of the level of martial arts accomplishment of its user.

3. Description of Related Art

There are numerous prior art martial arts weapons, practice and demonstration devices known in the prior art. In addition, a large number of weapon-type implements designed for use by law enforcement personnel are known, some of which include features such as light or sound emitting sources. The most relevant-appearing of such references are discussed below.

U.S. Pat. No. 1,066,540 issued to G. A. Smithwick on Jul. 8, 1913, entitled "Combined Club ad Flash Light", discloses a policeman's club having a flashlight built into the handle end of the club. A cavity in the handle for holding the battery and light is covered by a lens, which lens is threadably secured to the end of the handle, while an on/off switch is provided on the side surface of the handle in a usual manner. U.S. Pat. No. 1,130,355 issued to E. L. & E. B. Von Eschen on Mar. 2, 1915 entitled "Policeman's Billy", discloses another policeman's club wherein a light means is positioned in the striking end, rather than the handle end, of the club. A wrist strap is also provided, as is a core for holding batteries and an on-off switch. Such references illustrate typical prior art arrangements for securing a light source in the end of a rod member.

U.S. Pat. No. 4,070,023 issued to J. J. Cutler on Jan. 24, 1978, entitled "Nunchaku", discloses a martial arts nunchaku weapon made from two hollow elongated aluminum members connected by a nylon rope. The faces of the elongated members are perforated along substantially their entire lengths, which perforations create a whistling sound when the members are twirled through the air. The perforations also improve the user's grip on the device.

U.S. Pat. No. 4,682,774 issued to S. M. Holy on Jul. 28, 1987, entitled "Collapsible, Re-Combinative Martial-Arts Weapon", discloses a martial arts weapon having numerous detachable parts that can be re-combined into a number of different weapons, including an escrima stick, bo, jo, tonfa, pugil stick, nunchaku, sectioned staff, hanbo, shikibo, and mace and chain. As shown in FIGS. 1 and 2, when used as a staff, a main center piece and two end pieces are threadably coupled together. No aesthetically pleasing features are disclosed, however.

U.S. Pat. No. 5,542,667 issued to J. R. Lezdey et al. on Aug. 6, 1996, entitled "Martial Arts Training Device", discloses a pole member having a striking cushion and wrap on one end and a hand grip that can slide along the pole member. In one embodiment, the pole is hollow and a sounding device is provided therein so that when a strike is made, a horn will sound. While the Lezdey training device can be made of various substances, including "polyvinyl chloride", and may be between 3-6 feet long, a clear acrylic demonstration staff or bong is not disclosed.

U.S. Pat. No. 5,547,190 issued to F. A. Mackewich, Jr. et al. on Aug. 20, 1996, entitled "Lighted Nunchakus", discloses a martial arts ninchaku comprised of a pair of hollow plastic handles having light sources disposed in such handles and a lens on the ends of the handles. Multiple light sources may also be situated through the handles so that the entire handle lights up, while in other embodiments a colored insert may be placed in the handles to alter the light effect, the light may be reflected off of spinning balls or mirror surfaces placed in the handles, the light may be either battery or chemically activated, or the handle members may be covered with a safety foam rubber material.

U.S. Pat. No. 5,630,998 issued to K. L. Parsons on May 20, 1997, entitled "Mock Training Baton and Method of Training Law Enforcement Personnel Using Same", discloses both straight and side handle mock or training batons made from a flexible plastic rod having a cushioning material thereover. Use in combination with a light or sound emitting means is not disclosed, however.

U.S. Pat. No. 6,126,292 issued to K. Liu on Oct. 3, 2000, entitled "Rice Flail Assembly", discloses another martial arts ninchaku-type device, also called a rice flail, comprised of a pair of transparent rods mounted on sleeves joined together at one end by a chain, and having mounted in each sleeve a battery-powered light which can be turned on to flash or light continuously.

U.S. Pat. No. 6,196,921 issued to R. L. Larson on Mar. 6, 2001 entitled "Interchangeable Martial Arts Weapons System", discloses another combination weapon system comprised of a plurality of parts that can be joined together in different ways to form different martial arts weapons, such as a Bo or Jo staff, Nunchaku, three-sectional staff, Tonfa, and Escrima. Lighting effects are also provided in the form of hollow illuminative tubes that can hold either a laser light element or a glow stick.

U.S. Pat. No. 6,299,537 issued to J. J. Clowser on Oct. 9, 2001, entitled "Laser Pointing Nunchaku Assembly", discloses a martial arts nunchaku having laser lights secured in and aimed outwardly from the ends of the handles. Such lights enhance the visual effect of the handles being twirled quickly through the air. A locking member is also provided to maintain the laser light in the handle but which is removable.

U.S. Pat. No. 6,398,652 issued to A. Schweizer et al. on Jun. 4, 2002, entitled "Flexible Nunchaku and Its Use", discloses a martial arts nunchaku that it is flexible and thus reduces the likelihood of physical injury occurring during use of the device. The handles are comprised of a pair of soft flexible PVC hoses joined on one end by a flexible cord, with a foam cover or jacket provided over the handles. Schweizer therefore teaches a practice nunchaku martial arts device, which although it could also be used for demonstration purposes is not aesthetically pleasing.

U.S. Pat. No. 6,722,656 issued to A. Heglund, JR. entitled "Jousting Apparatus", discloses a jousting device comprised of a pair of long handle components joined together by a rope or cord, such that when handles are held by different participants, such participants can engage in a jousting activity.

U.S. Pat. Appln. Pub. No. 2002/0155894 filed by M. A. Evenson and published on Oct. 24, 2002, entitled "Baton System", discloses another policeman's baton having a handle portion and a striking portion, both preferably made of nylon. The overall length of the baton can range between 1-4 feet, and grooves and ridges are provided on the handle portion to create a better frictional grip of the device in the user's hands. In addition, a weight is movably positioned in an orifice in the outer end of the striking portion of the device, which weight is designed to increase the "sweet spot" of the baton upon an impact with an object.

U.S. Pat. Appln. Pub. No. 2004/0127292 filed by L. Chan et al. and published on Jul. 1, 2004, entitled "Sparring Weapon", discloses a martial arts device having a handle section and an elongated blade section, which blade section is covered by an impact absorbent padding. A movable weight is also provided in an orifice in the blade section which helps adjust the balance of the device as it is swung.

U.S. Pat. Appln. Pub. No. 2005/0113218 filed by S. A. Sewitch, JR., and published on May 26, 2005, entitled "Multipurpose Martial Arts Training Device", discloses a martial arts device comprised of two separate tubular components that can be used either together or separately to form different martial arts weapons. Such tubular components may be made of a plastic polymer, and include a serrated gripping means. The Sewitch training device does not exhibit the unique characteristics and features of the present inventor's demonstration staff, however.

U.S. Design Pat. No. 320,428 issued to J. W. Rust on Oct. 1, 1991, entitled "Martial Arts Bar", discloses an ornamental design for a staff having a pair of handles extending outwardly at a right angle from the longitudinal axis of such staff. The handles extend outwardly from the handle at slightly different angles. In addition, U.S. Design Pat. No. 428,636 issued to L. J. Weaver on July 25, 2000, entitled "Karate Staff", discloses an ornamental design for a karate staff having oar-like members situated on the ends of the staff.

While the prior art devices discussed above are useful for their own particular indicated purposes, none exhibits the unique combination of features and advantages of the present inventor's demonstration staff or bong. The present inventor has made several improvements to a demonstration staff that are not shown in or anticipated by the prior art. One such improvement is the provision of a clear acrylic staff having a highly polished outer surface in combination with at least one light source or light emitting means connected to the staff in a manner so that when the light is activated, it appears that lights are situated along the entire length of the staff, rather than just on one or both ends. Such arrangement provides a unique and more attractive appearance than prior art staff arrangements without having an effect on the structural integrity of the staff. A second improvement is the provision of a unique indicator means for displaying the martial arts rank or level of accomplishment of the owner of the staff. Such indicator means is preferably exhibited in the form of one or more strategically located rings etched into the outer surface of the staff, which rings are then provided with a clearly visible color or other marking scheme that is indicative of the ranking system for the particular martial arts discipline. Importantly, it has been found through experimentation that such rings must be confined to certain areas along the length of the staff, or otherwise the structural integrity of the staff could be comprised, causing the staff to crack or break even when used only under demonstration type conditions. Other features such as a sound emitting means, serrated gripping areas, and other custom markings that further personalize the staff device may also be provided to further increase its desirability. The resulting staff, it is believed, is significantly more aesthetically appealing than prior known demonstration staffs when used in a demonstration activity or show.

OBJECTS OF THE INVENTION

It is therefore a primary object of the invention to provide a more aesthetically pleasing decorative martial arts implement of a type used in martial arts demonstrations.

It is a further object of the invention to provide a martial arts demonstration implement made from transparent plastic and provided with a lighting means at one or both ends of the implement which light up during use and emit attractive light patterns during demonstrations.

It is a still further object of the invention to provide a martial arts demonstration staff made from a highly polished acrylic material that can be easily illuminated by a light source secured in at least one end of the staff which effectively illuminates the entire staff as a result of reflectance along the inside of the staff reflected out through clear plastic sides, giving the staff a more aesthetically pleasing and eye-catching appearance.

It is a still further object of the invention to provide a martial arts demonstration staff wherein the staff is provided with a means for making an attractive sound or whistling noise when the staff is moved quickly through the air.

It is a still further object of the present invention to provide a martial arts demonstration staff having colored rings denoting the martial arts rank or level of accomplishment of the user or owner, which rings are positioned on the staff such that its structural integrity is not affected.

It is a still further object of the invention to provide a martial arts demonstration implement in the form of a bong in which the bong is lighted and is supplied with surface configurations in the form of closely spaced colored rings denoting the martial arts rank of the user or owner of the martial arts implement, such rank being coded in by the combination of the rings.

It is a still further object of the invention wherein the rings denoting rank applied to the bong are provided away from the ends and the middle of the bong where they have been found to raise undesirable stresses.

It is a still further object of the present invention wherein a clear plastic bong is provided with spaced knurled hand grips on its surface and the martial arts rank of the user or owner is indicated by combinations of rings outbound of the knurled hand grips on the martial arts implement.

It is a still further object of the present invention to provide a martial arts demonstration staff that can serve as an attractive memento of one's martial arts accomplishments and stature.

It is a still further object of the invention to provide a martial arts implement in the form of a bong in which said bong is polished and provided in the ends of said bong with a hollow central cavity occupied by a light means having a depressible switch button on the side, said button extending part way into an orifice extending from the side of the bong into the hollowed out interior into which the lighting means is inserted and the light with the depressible switch button extending part way into the orifice which extends to the surface and retains the light fixture in place while also preventing the switch from being accidentally activated or deactivated during handling of the bong during demonstrations or otherwise.

It is a still further object of the invention to provide a clear plastic bong formed of clear polished acrylic plastic having at least one light fixture in the ends directed inwardly into the bong and having depressed rings or grooves in the surface at predetermined positions with coloring material in or at the surface of the rings which is illuminated during use of the bong in demonstrations not only indicating the rank of the user of the bong, but also adding a colorful display during demonstrations.

It is a still further object of the invention to provide a bong providing a combination of a multiplicity of the above characteristics.

Still other objects and advantages of the invention will become clear upon review of the following detailed description in conjunction with the appended drawings.

SUMMARY OF THE INVENTION

The present invention is directed to a more aesthetically pleasing martial arts demonstration staff of a type used primarily for entertainment purposes at martial arts demonstration shows, events, and the like, as well as a staff that serves as a momento for the owner and is indicative of the level of his or her martial arts accomplishment. More particularly, the staff of the present invention, although it can be any type of staff, is preferably a bo staff or bong typically having a length of about five or six feet and a width of about one inch, and being made of a highly polished acrylic material. In one preferred embodiment, longitudinal bores are provided in the ends of the staff for receiving light emitting devices. In a preferred embodiment, transverse holes extending between the outer surface of the staff and the longitudinal bores are also provided, which receive spring activated on/off buttons or switches extending outwardly from the side surfaces of the light members. When the light members are turned on, the highly polished surface of the acrylic staff causes light emitted from such light members to reflect more or less evenly along the entire length of the staff, giving the staff the aesthetically pleasing appearance that the entire length of the staff is lighted. In addition, markings indicative of the level of martial arts accomplishment or rank of the staff owner, preferably in the form of one or more rings fixed in the outer circumferential surface of the staff and marked or colored using a known system to indicate such rank, are also provided. Importantly, the position of these so-called "rank rings" on the staff is restricted to areas wherein the structural integrity of the staff is not affected by the rings. In another embodiment, staggered square channels may be provided on the outer surface of the staff near its ends, which channels when the staff is twirled at a high rate of speed create a whistling noise or similar type of sound. The staff may also be provided with knurled handgrip areas and other markings and engravings which create a more personalized staff that can serves as a valued memento for its owner. In a further embodiment the rank indicating rings or grooves may be provided with transparent color light effervescing or phosphorescent material to provide lighted indications of the owners martial arts rank.

DESCRIPTION OF THE PREFERRED EMBODIMENTS

Figure 1:
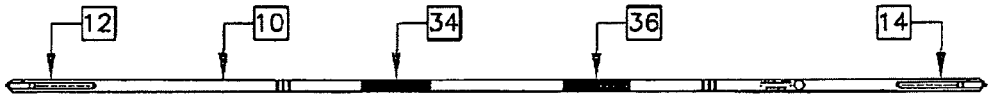
FIG. 1 is an isometric view of the demonstration martial arts staff of the present invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

As indicated above, special martial arts demonstration equipment has in recent years become popular. Some of such equipment has been lighted and otherwise made decorative and is usually made lighter or in some manner padded so that accidental injury to mass or close packed participants in such demonstrations does not occur. The present invention is an improved demonstration bong, or bo staff, which is formed of polished transparent plastic such as clear preferably acrylic transparent plastic, which is lighted throughout by end lights directed inwardly from the ends. It has been discovered that if a clear polished surface plastic is used rather than a frosted surface that the light is transmitted through the entire bong structure and reflected more or less uniformly through the sides providing a fully illuminated staff which during demonstrations of skill shines attractively throughout its length and can be manipulated attractively for the benefit of an audience, particularly when movements are executed in the dark or in a partially darkened environment. Preferably the bong of the invention also incorporates one or more of several accoutrements, or additional features, including battery powered lights having push button switches which double as easily operated retention means as well as easily activated switches. The bong also preferably incorporates martial art expertise designations in the form of martial art rank designation rings formed on the surface of the bong, preferably comprising circular grooves placed in low stress areas of the bong structure and having colored rings or light reflective material placed in such rings to designate the rank expertness of the martial art demonstrator using the bong.

All participants in any sport or organization enjoy display of their rank to others, particularly if such rank is relatively elevated compared to their contemporaries, which elevated rank those who appear in public demonstrations are likely to have attained. Consequently, it has been found that such rank designated or equipped bongs have much appeal and attractiveness to the users thereof. Furthermore, if the demonstration in which the bong of the invention is used is to exhibit the lesser but still impressive skill of relative tyros or beginners in the art, the lighted or illuminated rank designating rings of the preferred bongs of the invention demonstrate and overall emphasize the hopefully impressive skill of such tyros while also partially excusing any lack of skill of execution in the minds of spectators. In other words, the indication of a lower rank in a readily visible manner will impress an audience with the quality of execution of even lower ranked individuals and prevent such less experienced individual from being embarrassed by their lesser performance while encouraging them to try to advance in rank. The bong of the invention also provides the rank designation rings of the invention in what has been found to be certain critical areas of the bong which have been found to be necessary to prevent failure of the structural integrity of the bong particularly for light demonstration bongs in order to prevent serious stresses from being created with possible breakage during use with possible injury to other participants. Thus, the rank rings or more particularly the grooves in which such rank rings of the invention are positioned on the bong or bo staff just to the outside of knurled bong handgrip section which are in turn placed adjacent each other in the center of the bong or on either side of the exact center. The high stress portions of the bong structure are in the center between the handgrips and because of a possible tendency for one half of the bong to be urged to turn faster than the other half at any given time occasioned by unequal force applied by the demonstrators grips and outboard of the grip as lateral force is applied to the bong of the invention by the operator or demonstrators hands. For example, the right arm and hand of the average demonstrator tends to be somewhat stronger than the left arm and hand and to place a somewhat stronger force on one side of the bong both in accelerating the rotary movement of the bong and in decelerating the movement pursuant to a change of rotational direction. Such uneven forces tend to cause stresses in the center of the bong and if it should break such break is likely to be at the center. Likewise, since the ends of the bong inherently accelerate and decelerate most significantly with change of motion the ends of a bong tend to over a period build up stress. Such build-up can be therefore result in failure of the ends of a bong after a period of use and accumulating stress. It has been found by the present inventor therefore that any grooves in the surface of the bong for receipt of rank designation rings should be placed in a relatively restricted are just outboard of the preferably knurled handgrip locations on the bong structure.

The bong of the invention also includes an especially designed and novel mounting of a battery powered light receptacle in the ends of the bong. Such novel arrangement includes a battery container, or receptacle, having an illuminated or illuminable light emitter such as an electric bulb or diode emitter arrangement extending inwardly into an illuminator chamber machined in the end of the bong. The outer base of the light receptacle is just sufficiently large enough to occupy or fill the interior end chamber of the bong when inserted therein with sufficient clearance to be easily slid into and out of such chamber. The receptacle base is preferably provided with a push button type switch which is just large enough to substantially fill a button switch orifice in the side of the bong structure, such orifice passing between the interior light accommodating chamber and the outside of the bong. In order to insert the light receptacle into the light chamber in the end of the solid bong after a suitable battery and light emitting element are secured in the receptacle, the button switch is depressed and the receptacle inserted into the hollowed out chamber in the end of the bong in line with the switch button accommodating orifice. When the receptacle reaches the appropriate position in the interior of the end of the bong the switch button, which has been depressed by the outer side of the light chamber, will snap outwardly into the button orifice and the light fixture will be held in place within the bong structure by such button extending into the orifice. Since the push button switch will comprise a type of depression switch frequently found on lighting fixtures of various kinds in which consecutive depressions of the switch will alternatively activate and deactivate electric flow in the light circuit, the operation of the switch will activate the illumination of the bong, preferably by a separate light fixture and switch in each end. The button switch will be sized such that its top when not compressed to effect activation or deactivation will extend a significant distance into the button switch orifice, but will not sufficiently high or elevated to reach the surface of the bong. Thus, the button switch when not depressed will extend into the side of the bong and serve to retain the light fixture in place in such bong, but will not be activated by hand manipulation of the bong. Instead, the light switch can be activated by a relatively sharp instrument such as the end of a mechanical pencil inserted into the switch orifice. Since it is desired that the light receptacle, which is subjected to a considerable amount of centrifugal force during use or manipulation of the bong, will not be forcibly flung or projected from the end and cause injury, the button type switch of such fixture should be relatively sturdy, meaning that the bottom of the button should be of sturdy metal construction (usually flared out by stamping or swaging) and the surrounding structure of the receptacle should be strong enough to withstand failure. If there is any doubt in such regard, the retention of the light fixture in the bong should be reinforced in some manner such as by the provision of a pin or threaded fastening passing through the exterior of the bong into the light fixture, which auxiliary element should be inspected frequently. Another preventative measure would be to provide a secured cap such as a threaded cap over the end of the light chamber which should itself be frequently inspected to make certain it is secure.

It has been discovered by the applicant that contrary to what occurs when a plastic bong has a frosty surface or other clouded surface on the bong if such bong is made of clear surface polished acrylic plastic, light at one end is transmitted through the entire bong or bo staff lighting up the entire staff rather uniformly particularly by the use of two lights in the ends. It is believed this is due to progressive reflectance from the inside of the polished surface back and forth at a critical angle down the length of the bong of a large percentage of the light passed into the plastic at one end until it reaches either the opposite end or any interrupting surface structures such as the knurled handgrip section or the rank rings encircling the bong. Thus, if the bong is clear and polished over the entire surface only one end light will be found necessary for substantially complete illumination. However, with the usual knurled handgrip portions of the bong of the invention plus the grooves of the rank rings, it is preferably to have a separate light source provided in both ends.

Referring to the figures there is shown in FIG. 1, a demonstration staff or bong 10 in accordance with the teachings of the present invention, the staff having a first end 12 and a second end 14, and a longitudinal axis 16. Staff 10 preferably is cylindrical in shape, and is preferably made from a clear or transparent acrylic material. The outer surface of staff 10 is preferably highly polished so that, as discussed in more detail below, when light members connected to or positioned at the ends of the staff are lighted, the light from such light members is reflected along the entire length of the staff so that the entire staff appears to be illuminated.

Figure 2:
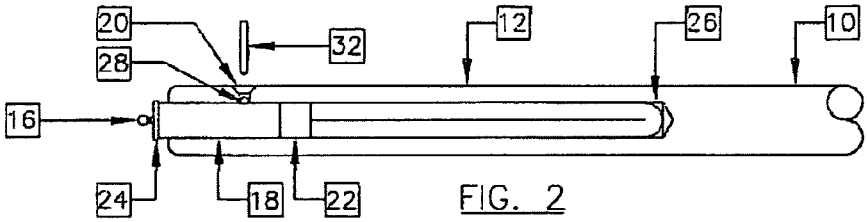
FIG. 2 is a partially cutaway sectional view of one end of the martial arts demonstration staff shown in FIG. 1 illustrating the light emitting means of the invention.

FIG. 2 is a partially cut-away view of one end section 12 of staff 10. Longitudinal bore 18 extends inwardly from the tip of end section 12, while smaller lateral bore 20 is provided in the side surface of staff 10 joining or providing a passageway between the outer surface of staff 12 and longitudinal bore 18. Secured in longitudinal bore 18 is light member or fixture 22 having a housing section 24 for holding electrical circuitry, a battery, and other components, and a light section 26, which can be any type of light, such as an LED light, bulb, chemical reaction light emitter, or the like. Extending outwardly from the side of housing section 24 of light member 22 is on/off or mode switch 28, which switch when light member 22 is placed in longitudinal bore 18 is aligned in lateral bore 20. Switch 28 is of the type that is spring activated such that spring pressure is constantly pressing switch 28 outwardly in any mode of use. As a result, light member 22 is held in place in bore 18 by switch 28 constantly pressing outwardly into lateral bore 20. Such arrangement also makes it relatively easy to operate light member 22 without having to remove such light member from bore 18, since switch 28 can be operated through lateral bore 20 using an auxiliary implement 32 to press downwardly on switch 28 as illustrated in FIG. 2. For example, in one arrangement pressing switch 28 causes light 26 to enter a blinking mode, pressing switch 28 a second time causes light 26 to be on constantly, and pressing switch 28 a third time turns light 26 off. Such arrangement of switch 28 in bore 20 also protects the switch 28 from being inadvertently turned on or off during a demonstration performance or the like since only a relatively narrow implement such as the end of a mechanical pencil, small screwdriver or the like can reach the button surface within the bore hole. While only end section 12 of staff 10 has been described, a similar bore arrangement and light member may be provided in end section 14. In addition, other arrangements for securing light members in staff 10 may also be utilized and still confer similar advantages, namely that light emitted from light member 22 is reflected along the entire length of staff 10, giving the appearance that a light in fact is extending along the entire length of the staff. The highly polished surface of the clear acrylic staff 10 is largely responsible for such effect, since the less clear or less polished the staff, the lesser such effect is exhibited in staff 10.

Figure 3:
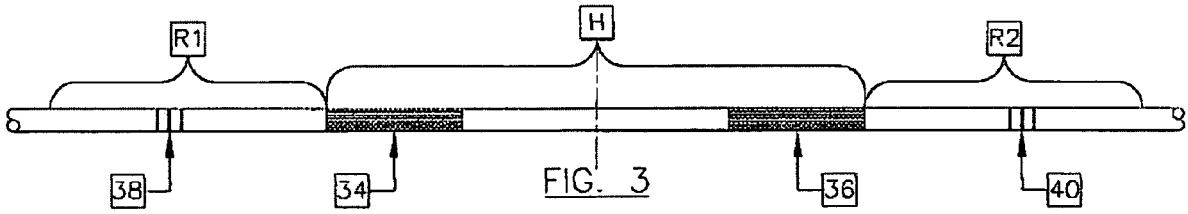
FIG. 3 is a partially cutaway isometric view of the center section of the martial arts demonstration staff of the invention.

Staff 10 also preferably includes serrated hand grip areas 34 and 36 spaced apart from the center of the staff. Alternatively, since hand grip area encompassing the entire center area of the staff may be provided, which area should be large enough to accommodate both or two hands slightly spaced apart, which is the usual manner in which the staff is gripped. FIG. 3 is a side view of the center section of staff 10, with end sections 12 and 14 being cut away. The center section of the staff 10, designated generally as "H", is the section in which hand grip areas 34 and 36 are normally placed, and area H may be approximately eighteen inches wide in an average length staff. Adjacent area H on either side are ring areas designated generally as R1 and R2, in which areas rank rings 38 and 40 are provided. Both areas R1 and R2 may be approximately 8-10 inches wide in a typical staff. Rank rings 38-40 are indicative of the martial arts rank or level of accomplishment of the owner of the staff 10. It should not be understood that the rank rings will extend over the surface of the staff for 8 to 10 inches, but only that this is the critical area for such rings to be positioned without detrimental effects upon stress in the bong as well on the proper lighting of the bong structure.

Figure 4:
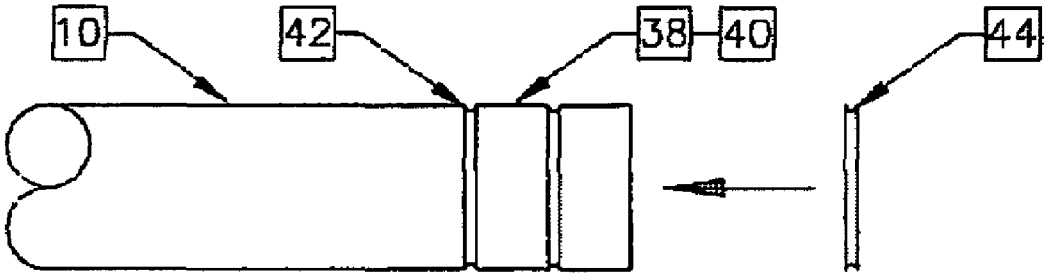
FIG. 4 is a partially cutaway view of the ranking ring feature of the invention.

As shown in FIG. 4, in the preferred arrangement for providing rank rings 38 and 40 on staff 10, at least one channel 42 is first etched or otherwise cut into the outer surface of staff 10 in either area R1 or R2. Colored rubber ring member 44 is then fitted snugly in channel 42. Additional channels 42 may be etched or otherwise provided in staff 10 adjacent the first channel, with ring members having the same or different colors then placed in such additional channels. It is critical to the structural integrity of staff 10 that channels 42 only be placed in staff 10 in the areas of the staff designated R1 or R2, as these areas are the areas of least flexing of the staff as it is whirled or manipulated at a high velocity through the air by the user. Since there is significantly more flexing in the center area designated by reference letter "H" in FIG. 3, as well as in the ends sections 12 and 14 of the staff, any channels or the like placed in such areas are likely to weaken the staff and increase the likelihood of the staff breaking during use. Generally, an area of about 9-20 inches from the center of the staff on either side is a preferred area for placement of channels 42, with the most preferred area being from about 12-16 inches from the center of the staff.

Figure 5:
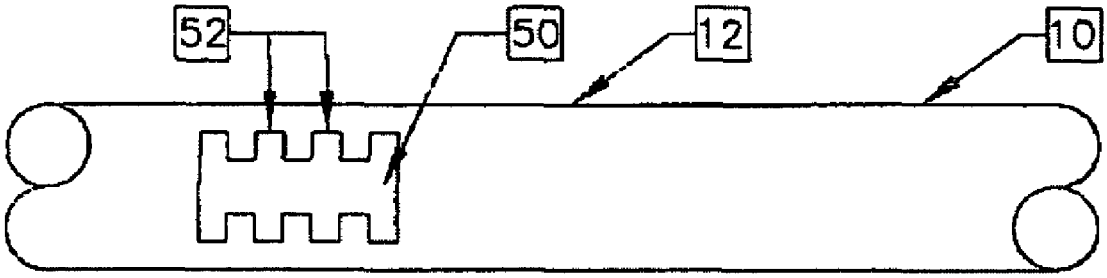
FIG. 5 is a partially cutaway view of one end of the martial arts demonstration staff of the present invention having channels cut in the outer surface of the staff to create whistling noise or sound as such end is moved briskly through the air.

FIG. 5 illustrates another feature of the martial arts demonstration staff of the present invention wherein staggered square channels 50 having sharp edges 52 are etched in the outer surface of the staff near first end 12 and second end 14, respectively. Such channels 50 may be provided in a number of different patterns or the like, such that when the staff is moved through the air at a high rate of speed, air passing through or over such channels creates a whistling sound. Such channels may be provided either alone or in combination with the light members discussed above with reference to FIGS. 1-2.

Figure 6:
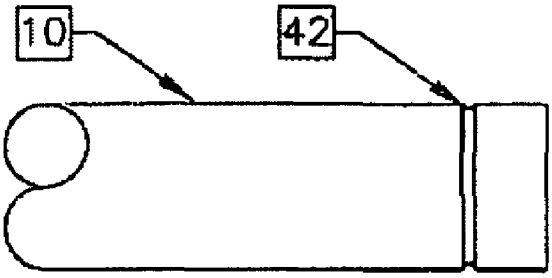
FIG. 6 is a view similar to FIG. 4 showing transparent coloring material such as powder particulates which are lighted by light reflected through the bong from the end lights and provide a lighted display of the owner or user's martial arts rank.

FIG. 6 shows a rank ring section of the bong of the invention similar to that shown in FIG. 4 in which rather than having a colored rubber or other composition ring as shown in FIG. 4, the groove is lined or alternatively filled with a colored light reflecting or preferably a phosphorescent or light emitting material which will glow with a predetermined light when struck by a light beam or activated by an impinging light beam in this case the light from the end light emitting fixtures of the invention. This arrangement provides colored illuminated rank rings which shine on the surface during demonstrations or displays depending upon the composition of the material contained in the rings.

Figure 7:
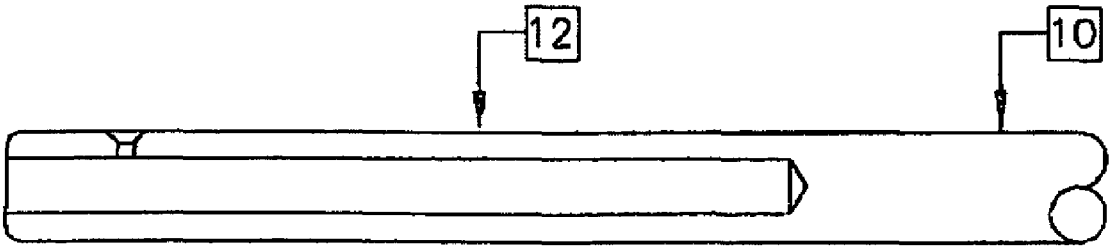
FIG. 7 is a partially broken away view of the end of a bong having a threaded end cap over the light emitting fixture providing a round end on the bong and protecting the light emitting fixture.

FIG. 7 shows in a partially cut away view a threaded end cap mounted over the light fixture in the end of the bong and provided with a rounded top to provide a more finished end to the bong.

As will be recognized from the above description and specifications the present invention provides an improved demonstration bong with attractive and interest attracting lighted effects and having additional improvements depending upon the desires of the user, including several types of rank rings provided in a critical area of the bong, a very convenient and effective way of maintaining light elements within the bong and if desired a whistling or other noise making apparatus or arrangement at the ends where it will provide interesting sound effects as the bong is moved through the air.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A martial arts demonstration staff comprised of:

(a) a solid substantially transparent elongated acrylic bo staff having a smooth outer surface, a center region that encompasses the midpoint of the staff, first and second regions adjacent the center region on both sides, and end regions adjacent said first and second regions, wherein said first and second regions are subjected to a lesser amount of stress than adjacent regions during use of the bo staff to demonstrate martial arts fighting techniques, (b) at least one light fixture mounted to one of the end regions of the bo staff having a light source directed inwardly for evenly illuminating the length of said staff, (c) one or more grooves provided in the outer surface of the bo staff and perpendicular to the longitudinal axis of the staff, wherein said grooves are parallel to each other and the position of which grooves is limited to being only in the first and second regions of the staff and are indicative of a level of accomplishment in a martial arts discipline, and (d) a longitudinal bore extending inwardly from the end of said end region sized in which the light fixture is snugly received, and a transverse aperture extending between the outer surface of the bo staff and said longitudinal bore, said light fixture having a depressible on/off and mode changing switch projecting outwardly from its side surface that is sized to be received in said transverse aperture, the switch also serving as a retaining member for holding the light fixture in the longitudinal bore.

2. The martial arts demonstration staff of claim 1 additionally comprising a longitudinal bore in both end regions of the staff, and a light fixture mounted in both of said longitudinal bores, whereby the mode of said light fixture is controlled by inserting a small tool in said transverse aperture and depressing the switch in order to change the mode, and whereby the light fixture is removable from said longitudinal bore by depressing the switch so that it no longer extends into said aperture.

3. The martial arts demonstration staff of claim 1 additionally comprising one or more colored ring members dimensioned to be received in each of said grooves in accordance with a color coding system.

4. The martial arts demonstration staff of claim 1 wherein the bo staff has a length of five feet, the center region has a width of approximately eighteen inches, and the first and second regions each have a width of approximately eight to ten inches.

5. The martial arts demonstration staff of claim 1 wherein the bo staff has a length of six feet, the center region has a width of approximately eighteen inches, and the first and second regions each have a width of approximately eight to ten inches.

6. The martial arts demonstration staff of claim 1 additionally comprising a means for creating a sound effect when said staff member is moved quickly through the air.

7. The martial arts demonstration staff of claim 6 wherein several staggered square channels having sharp edges are provided in the outer surface and near the ends of said bo staff such that when the staff is twirled at a high rate of speed, a whistling noise is created.

8. The martial arts demonstration staff of claim 1 wherein said light fixture is comprised of a light receptacle, a battery container, a light emitting element, and an activation means.

9. The martial arts demonstration staff of claim 1 additionally comprising a cap member which is securable over the opening in the end region to said longitudinal bore.

10. The martial arts demonstration staff of claim 1 wherein said grooves are coated with a light effervescing or phosphorescent material in accordance with said color coding system.

11. The martial arts demonstration staff of claim 1 wherein said grooves are preferably placed at a distance of between 12-16 inches from the midpoint of a bo staff having an overall length of between five and six feet.

12. The martial arts demonstration staff of claim 1 additionally comprising knurled hand grip area in said center region.

* * * * *